United States Patent [19]

Shumway et al.

[11] Patent Number: 4,934,972

[45] Date of Patent: Jun. 19, 1990

[54] WATER SKIER SAFETY ALARM

[76] Inventors: Jack E. Shumway, 2739 Grassmere, Shreveport, La. 71108; Dennis R. Potvin, 3564 Youree Dr., Shreveport, La. 71105

[21] Appl. No.: 265,030

[22] Filed: Oct. 31, 1988

[51] Int. Cl.[5] ..... G08C 5/00

[52] U.S. Cl. ..... 441/69; 114/253; 116/173

[58] Field of Search ..... 114/253; 441/69; 116/281-283, 173, 175, 209, 28 R, 26

[56] References Cited

U.S. PATENT DOCUMENTS

| | | | |
|---|---|---|---|
| 3,021,513 | 2/1962 | Lankey | 114/253 |
| 3,103,005 | 9/1963 | Hills | 441/69 |
| 3,602,188 | 8/1971 | Penaflor | 114/253 |
| 3,798,631 | 3/1974 | Langford | 441/69 |

*Primary Examiner*—Sherman D. Basinger
*Assistant Examiner*—Edwin L. Swinehart
*Attorney, Agent, or Firm*—John M. Harrison

[57] ABSTRACT

A water skier safety alarm which is characterized by a flag-deploying mechanism mounted on a boat and designed to receive and deploy a flag when a water skier towed by the boat releases his grip on the tow rope handle. In a first preferred embodiment, the flag-deploying mechanism includes a mechanical linkage which employs a solenoid to normally retain a flag in lowered configuration when a water skier is gripping the tow rope handle and to deploy the flag when the handle is dropped, responsive to operation of a pressure-sensitive switch in the handle. In a second preferred embodiment, the flag is mounted on the telescoping end of an antenna and is stored in the antenna deployment housing when the water skier is gripping the tow rope handle. The flag is telescopically extended from the antenna housing responsive to dropping of the handle and activation of a pressure-sensitive switch in the handle.

12 Claims, 2 Drawing Sheets

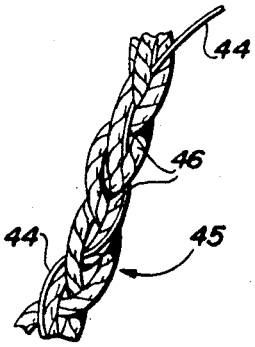
FIG. 3
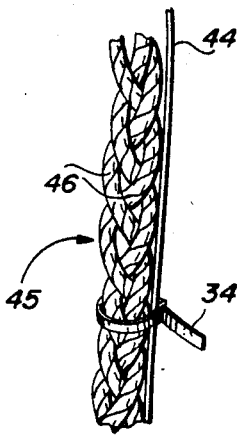
FIG. 4
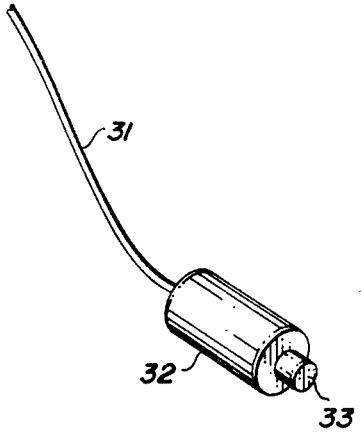
FIG. 5
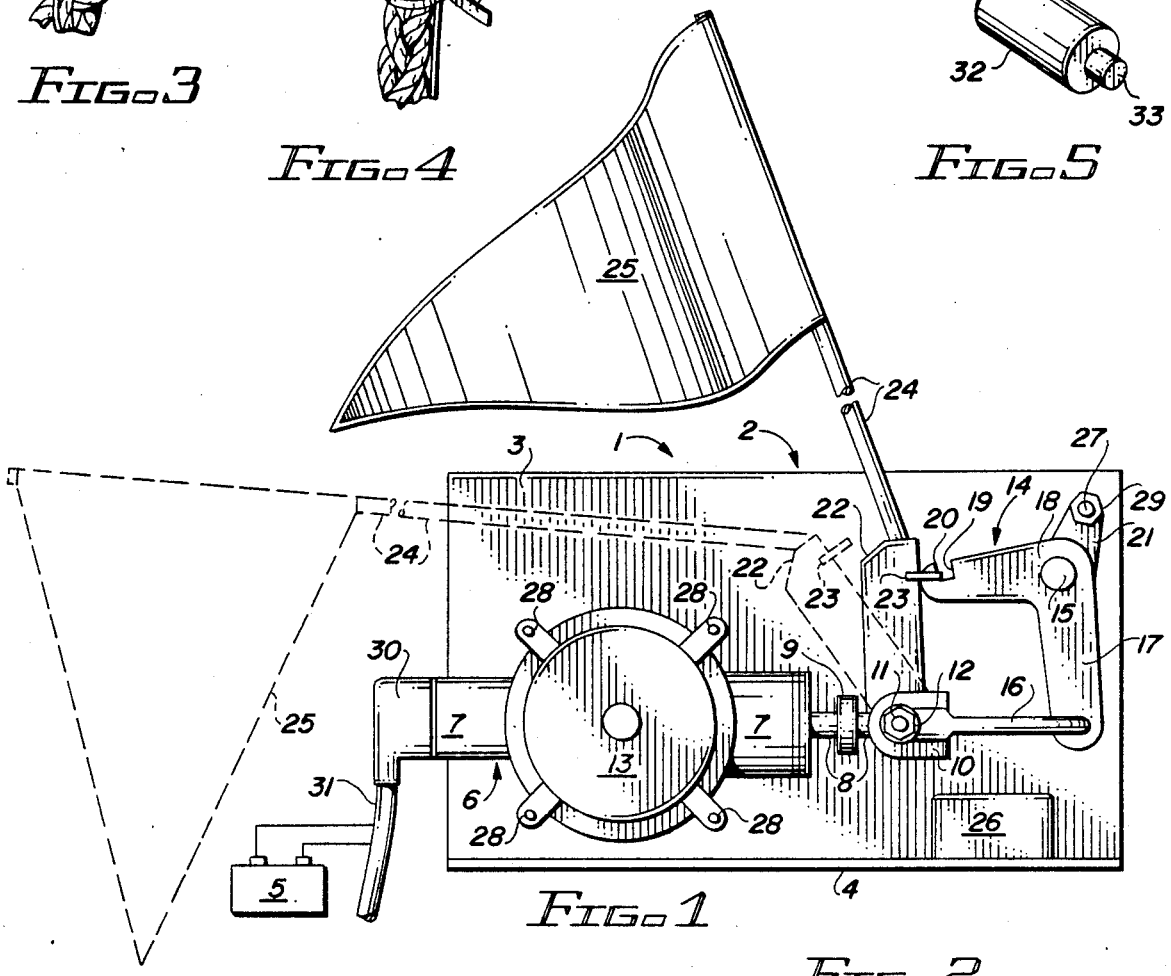
FIG. 1
FIG. 2
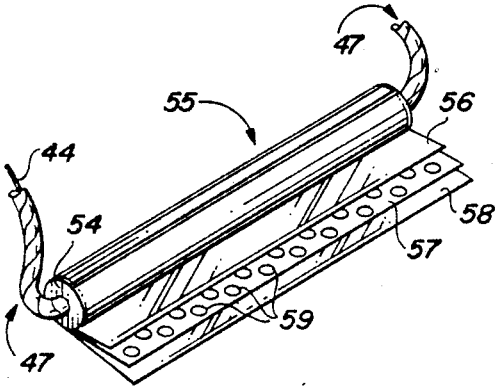
FIG. 7
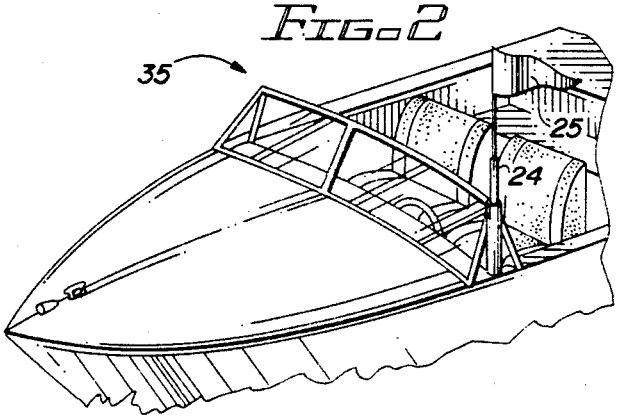

WATER SKIER SAFETY ALARM

BACKGROUND OF THE INVENTION

1. Field of the Invention

This invention relates to safety devices for water skiers and more particularly, to a water skier safety flag and audible alarm which is designed to deploy a flag and sound an alarm when the water skier releases the tow rope handle while skiing. In a first preferred embodiment, the flag is pivotally attached to a deploying mechanism which incorporates a solenoid to maintain the flag in folded configuration while the skier is holding the tow rope handle and deploy the flag upwardly when the skier releases the tow rope handle, either by falling or at the end of a ride. In a second preferred embodiment, the flag is attached to the end of a telescoping antenna and is normally telescoped inside an antenna housing when the skier is gripping the tow rope handle. The flag is extended telescopically from the antenna housing when the tow rope handle is released by the skier. In both embodiments of the invention an audible alarm may be utilized as desired, and the handle is equipped with a pressure-sensitive switch to operate the flag deploying mechanisms.

One of the problems which exists in water skiing and particularly, while water skiing in congested lakes and other waterways, is that of making the driver of the towing boat, as well as the drivers of other boats in the area, aware that the water skier has fallen. In many instances, the boat driver and the water skier are the only two participants and since the boat driver normally is viewing the water ahead of the boat, he is usually unable to simultaneously view the skier behind the boat. Although most states have enacted legislation to require at least one observer riding in the boat with the driver, this law is rarely followed and under circumstances where there is no such observer, a fallen water skier is at risk, in that he can be struck by another boat or skier in the area. In many cases, the water skier falls and the boat driver is unaware of the event for a considerable period of time, which leaves the skier in the waterway for several minutes before the driver discovers that he is no longer skiing and is able to make a turn to retrieve the fallen skier.

2. Description of the Prior Art

Various types of safety devices are known in the art for warning the drivers of boats that a skier is in the water. U.S. Pat. No. 3,602,188, dated Aug. 31, 1971, to Daniel M. Penaflor, details a flag system for ski boats which is automatically operated by a release of the tow line tension to raise a flag for warning other boats as to a downed skier. A spring-loaded flag standard is retracted by tension on a tow line for water skiers and upon tension release, automatically raises the warning flag. A normally closed switch in the system operates a warning light which is visible to a boat operator upon release of the tow line by a skier. U.S. Pat. No. 3,735,724, dated May 29, 1973, to Nathan W. Miller, details a "Water Skier Safety Alarm". In this device, a safety alarm flag is mounted to a ski tow boat such that, when a skier towed by a boat has fallen, the flag is automatically raised and is visible by operators of other boats in the vicinity and also by the operator of the boat that had been towing the downed skier. A flag-carrying arm is pivotally mounted to the ski tow board and is spring-urged to an upright alarm position. A tension line is connected to the flag arm above its pivot and is guided downwardly and rearwardly along the boat rail, for connection to the skier tow line. Fluid damping is provided for control of the raising motion of the flag-carrying arm. A "Signal Device for Water Skiing" is detailed in U.S. Pat. No. 3,786,778, dated Jan. 22, 1974. The device includes a pivotal flag or signal device for water skiing which is designed to warn other boats when a skier is down in the water. An over-centered spring mechanism is designed to securely position the signal device in either an operative upright position or a horizontal storage position. The signal device is mounted on an extendible shaft for varying the height of the signal device and to insure compact storage in an inoperative position. U.S. Pat. No. 3,797,450, dated Mar. 19, 1974, to Lloyd E. Frisbee, details an "Emergency Signal Flag". The device includes a signal flag apparatus which has an elongated tube storing a shaft, with a flag secured along one end thereof. The tube houses a resilient member designed to forcibly urge the shaft and flag out of the tube in a fully deployed condition. A push- button device holds the shaft and flag in a storage position within the tube and upon actuation, permits the resilient member to project the shaft and flag out of the tube. A pull cord is attached to the end of the shaft, which when pulled, causes the shaft and flag to be withdrawn into the tube for storage and reset purposes. A bracket pivotally mounts the tube on an appropriate portion of a vehicle such as a boat. A "Boat Flag Holder" is detailed in U.S. Pat. No. 3,941,340, dated Mar. 2, 1976, to Leon B. Rankins. The holder is designed to receive the shaft or pole of a signal device used in boats to indicate that an occupant of the craft or water skier being towed by the craft is in the water. The holder includes a pair of relatively rotatable disc-like members, the first of which is attached to the boat and the other being rotatably secured thereto. The second member receives a flag pole or shaft and as the member rotates, the shaft is moved between a vertical operative position and a horizontal inoperative position. Automatic stop means control the rotation, so as to readily position the shaft in the two positions. U.S. Pat. No. 4,035,856, dated Jul. 19, 1977, to Gary R. Oberg, details a "Water Ski Safety Flag". The water ski safety flag is characterized by a visual marker for attachment to the flotation gear of a water skier to enable the skier to be more readily detected when down in the water. The marker includes a staff having a flag member secured to the upper end thereof and attachment means are secured to the lower end of the staff, to permit releasible attachment of the staff and flag member to the flotation gear of the water skier. Attachment means includes a resilient belt or strap member which is coupled at its upper end to the staff and at its lower end to the staff-securing buckle or plate, the attachment being such that the belt and the staff form a closed loop for the attachment of the safety flag to the flotation gear of the skier. A "Warning Flag for Vehicles" is detailed in U.S. Pat. No. 4,090,468, dated May 23, 1978, to Gary L. D'Spain. The warning flag is characterized by a pivotally-mounted, spring-loaded arm which is normally folded against the bias in the spring and is deployed in a substantially vertical configuration on a boat or vehicle pursuant to operation of the spring when in functional configuration. U.S. Pat. No. 4,122,796, dated Oct. 31, 1978, to Kurt T. Pressler, details an "Adjustable Pennant Warning of Downed Water Skiers". The device is characterized by a hand-powered top action assembly which is permanently mounted to a stationary portion of a boat, to support a warning pennant attached to the mast of the assembly and allow the pennant to be relocated as required, to satisfy U.S. Coast Guard safety regulations. U.S. Pat. No. 4,475,476, dated Oct. 9, 1984, to Thomas L. Howard, includes a "Signal Staff For a Person in the Water". The device indicates by day or by night, the location of a person adrift on the surface of a body of water and includes a vividly colored, inflatable tube made of a thin, flexible material provided with a one-way valve for inflation by mouth. The device further includes a miniature electric lamp coupled to a water-activated battery and the tube is permanently attached to a life jacket or other garment that has a flag secured to its free end. The tube, flag or both, may contain a metallic pigment or may be covered with a layer of such material, to render it radar detectable. A "Flag Raising Device for Water Skiing" is detailed in U.S. Pat. No. 4,545,320, dated Oct. 8, 1985, to Brett Lewis. The device includes a pivot member, in which a flag pole is mounted, and which is spring-biased toward a position in which the flag pole is vertical. A retaining device normally holds the pivot member in a position in which the flag pole is lowered. When the skier falls, the retaining device is released either manually or automatically, to allow the pivot member to move under the spring-bias and raise the flag pole. U.S. Pat. No. 4,752,264, dated Jun. 21, 1988, to Melendez, et al, details a "Warning Flag for Skiers". The device includes a flexible mast attached to the skier's life jacket at the appropriate center of the jacket's rear portion. The flexible mast extends upwardly from the life jacket for a substantial distance beyond the highest point of the skier's head and terminates in a highly visible warning flag at its upper end.

It is an object of this invention to provide a water skier safety alarm which is characterized by a flag-deploying mechanism mounted on a boat and a switch mounted on the tow rope handle of a tow rope, in order to facilitate operation of the flag-deploying mechanism to raise a flag responsive to operation of the switch on the tow rope handle.

Another object of the invention is to provide a new and improved water skier safety alarm which is characterized by a flag-deployment device mounted on a boat, with a flag staff pivotally secured to the flag deployment device, a pressure switch located on the handle of a tow rope and wiring connecting the pressure switch to the flag-deployment device, wherein the flag is normally deployed in retracted configuration when the skier is gripping the tow rope handle and is pivoted upwardly in a substantially vertical, easily visible configuration when the skier releases the tow rope handle.

Still another object of this invention is to provide a new and improved water skier safety alarm which is characterized by a flag mounted to a telescoping antenna and normally telescoped into the antenna housing, a pressure-sensitive switch attached to the handle of a tow rope and wiring connecting the switch to the telescoping antenna, wherein the flag is normally deployed in the antenna housing when a skier is gripping the tow rope handle and the switch is closed, and the flag is telescopically extended from the housing when the skier drops the handle and the switch is open.

SUMMARY OF THE INVENTION

These and other objects of the invention are provided in a new and improved water skier safety alarm which is characterized in a first preferred embodiment, by a flag pivotally attached to a deployment mechanism which is secured by means of wiring to the handle of a tow rope, such that gripping of the tow rope handle by a water skier closes a pressure switch located in the handle and maintains the flag in retracted configuration and release of the tow rope handle by the water skier allows the switch to open and the flag to pivotally deploy upwardly, where it is easily visible. In a second preferred embodiment, the flag is attached to one end of a telescoping antenna which is normally deployed in the antenna housing when the skier grips a pressure switch in the tow rope handle and the flag extends telescopically from the housing when the water skier releases his grip on the tow rope handle and allows the switch to open.

BRIEF DESCRIPTION OF THE DRAWINGS

The invention will be better understood by reference to the accompanying drawings, wherein:

FIG. 1 is a side view, partially in section, of a first preferred embodiment of the water skier safety alarm of this invention;

FIG. 2 is a perspective view of a boat, more particularly illustrating a preferred mounting position for the water skier safety alarm illustrated in FIG. 1;

FIG. 3 is a sectional view of a water ski tow rope, illustrating a preferred plaited deployment of the connecting wiring associated with the water skier safety alarm;

FIG. 4 is a sectional view of a water ski tow rope, more particularly illustrating an alternative configuration for the connecting wiring of the water skier safety alarm;

FIG. 5 is a perspective view, partially in section, of a hand-operated switch for manually deploying the flag in the water skier safety alarm;

FIG. 7 is a perspective view of a second preferred tow rope handle and pressure switch configuration;

DESCRIPTION OF THE PREFERRED EMBODIMENTS

Figure 6:
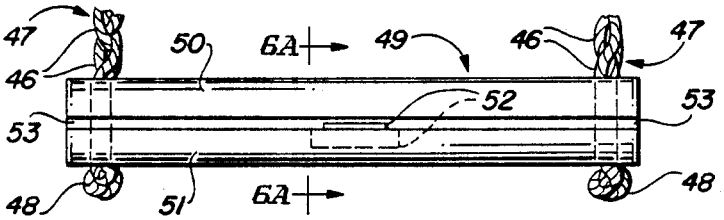
FIG. 6 is a top view of a first preferred tow rope handle configuration with a pressure switch provided therein.

Referring now to FIGS. 1 and 2 of the drawings, in a first preferred embodiment the water skier safety alarm of this invention is generally illustrated by reference numeral 1. The water skier safety alarm 1 includes a mount plate 2, which is secured to a boat 35, illustrated in FIG. 2, adjacent to the driver's seat, as illustrated in FIG. 2. It will be appreciated by those skilled in the art that the water skier safety alarm 1 can be mounted in any desired location on the boat 2, although the location indicated in FIG. 2 is preferred, since it is immediately adjacent to the driver and will therefore serve to command the driver's attention when activated. The mount plate 2 is characterized by a mount plate side panel 3 for mounting to the boat 35 using fasteners such as bolts or screws, (not illustrated) as desired, and a mount plate bottom 4 which extends outwardly from the bottom edge of the mount plate 3 at approximately a 90 degree angle, as illustrated in FIG. 1. A horn 26 is mounted on the outwardly-extending mount plate bottom panel 4 and a solenoid 6 is secured by means of housing mount bolts 28, to the mount plate side panel 3, as further illustrated in FIG. 1. The solenoid 6 is further characterized by a piston chamber 7 which receives a solenoid piston 8 in reciprocating relationship and a solenoid housing 13, for operation of the solenoid 6 in conventional fashion. An adjusting collar 9 is provided on the extending end of the solenoid piston 8 and the solenoid piston 8 is secured to a universal coupler 10, which carries an operating lever link 16 in pivotal relationship. The extending end of the operating lever link 16 is attached to the downwardly-extending link leg 17 of an operating lever 14 and the oppositely-disposed retainer leg 18 of the operating lever 14 is fitted with a retainer leg slot 19, which defines a retainer leg finger 20 at the end thereof. The operating lever 14 is pivotally secured to the mount plate side panel 3 by means of an operating lever pin 15, which is attached to a lever pin plate 21, that is seated against the mount plate side panel 3 by means of a plate bolt 27 and a cooperating plate nut 29. A flag base hook 23 engages the retainer leg finger 20 and is secured to the flag base 22 and the flag base 22 is, in turn, pivotally mounted at the bottom thereof to the coupler bolt 11 by means of the nut 12. The coupler bolt 11 and the nut 12 also secure the universal coupler 10 and the operating lever link 16 in the operating position illustrated in FIG. 1. One end of a flag staff 24 is secured to the flag base 22 and the flag staff 24 extends upwardly to receive a flag 25 at the opposite end thereof. A solenoid plug 30 is plugged into the end of the piston chamber 7 of the solenoid 6 and plug wiring 31 extends from the solenoid plug 30 to a pressure-sensitive switch (not illustrated), for purposes which will be hereinafter further described. The positive and negative terminals of a battery 5 are wired into the plug wiring 31 in conventional fashion, in order to energize the solenoid 6. Accordingly, as illustrated in FIG. 1, it will be appreciated that energizing of the solenoid 6 effects retraction of the normally extended solenoid piston 8, to pivotally deploy the flag staff 24 and the flag 25 in the upright, functional configuration. Moreover, de-energizing of the solenoid 6 extends the solenoid piston 8 responsive to operation of a timing circuit and relay (not illustrated) which reverses the voltage in the solenoid 6, and pivots the flag staff 24 and the flag 25 into the retracted configuration, as illustrated in phantom, and as hereinafter further described.

Figure 10:
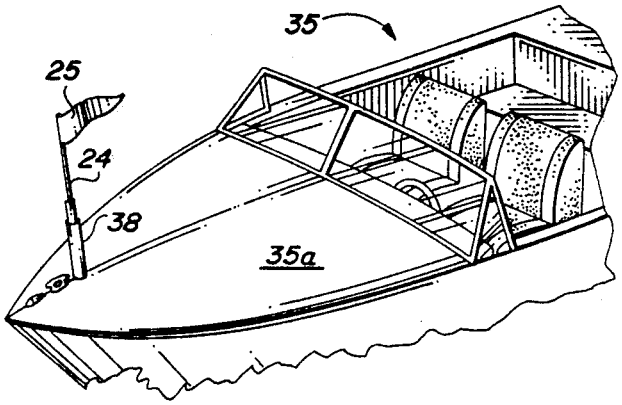
FIG. 10 is a perspective view of a boat, more particularly illustrating a preferred location for the water skier safety alarm illustrated in FIGS. 8 and 9.
Figure 8:
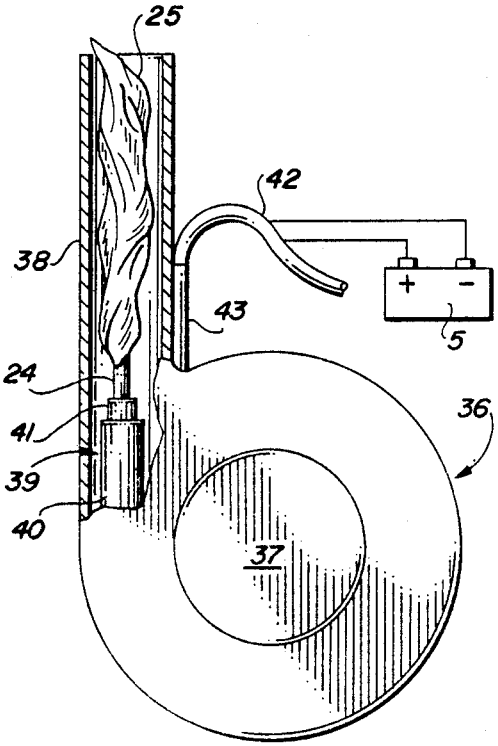
FIG. 8 is a side view, partially in section, of a second preferred embodiment of the water skier safety alarm of this invention in retracted configuration.
Figure 9:
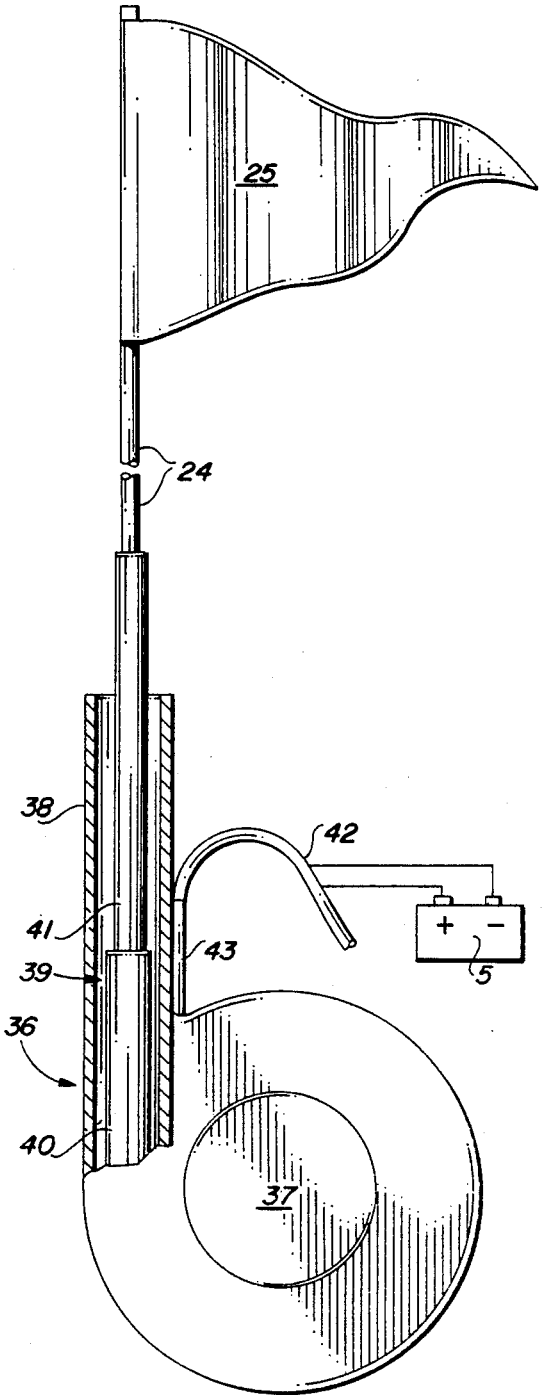
FIG. 9 is a side view, partially in section, of the water skier safety alarm illustrated in FIG. 8 in extended configuration.

Referring now to FIGS. 8–10 of the drawings, in another preferred embodiment of the invention the water skier safety alarm is characterized by an antenna deployment apparatus 36 which includes a motor housing 37 and an antenna housing 38, projecting upwardly from the motor housing 37, and designed to receive and enclose a telescoping antenna 39. The antenna 39 is further characterized by a base element 40 which is rigidly attached to the interior of the antenna housing 38, a middle element 41 and a flag staff 24, which telescopes inside the middle element 41. A flag 25 is attached to the extending end of the flag staff 24, as illustrated in FIGS. 8 and 9. Antenna deployment wiring 42 projects from a wiring receptacle 43, provided in the motor housing 37, for attachment at the opposite end to a pressure-operated switch (not illustrated) connected to a tow rope handle (not illustrated), as further hereinafter described. The positive and negative terminals of a battery 5 are wired into the antenna deployment wiring 42 in conventional fashion, in order to energize the motor (not illustrated), in the antenna deployment apparatus 6. As illustrated in FIG. 10, in a preferred embodiment of this aspect of the invention, the antenna housing 38 projects from the boat deck 35*a*, while the motor housing 37 is located beneath the boat deck 35*a*, as illustrated. Since the normal function of the antenna deployment apparatus 36 is to extend the middle element 41 and the flag staff 24 from the antenna housing 38, a relay (not illustrated) is employed to reverse the operation of the antenna deployment apparatus 36 and extend the middle element 41 and the flag staff 24 responsive to opening of the pressure-operated switch, as hereinafter described.

Referring now to FIGS. 3 and 4 of the drawings, in both of the embodiments of the invention illustrated in FIGS. 1 and 2 and FIGS. 8–10, respectively, the tow rope wiring 44, which is attached to the plug wiring 31 of the water skier safety alarm 1 illustrated in FIGS. 1 and 2 and to the antenna deployment wiring 42 of the antenna deployment apparatus 36, may be either intertwined, interwoven or plaited in the rope strands 46 of the tow rope 45, as illustrated in FIG. 3, or attached to the tow rope 45 by means of cable ties 34, as illustrated in FIG. 4. Accordingly, it will be appreciated by those skilled in the art that the tow rope wiring 44 in both embodiments of the invention can be plaited with the tow rope 45 during manufacture or as a separate step as illustrated in FIG. 3, or retrofitted to an existing tow rope 45, using spaced cable ties 34 as illustrated in FIG. 4.

Referring now to FIGS. 1, 5 and 8 of the drawings, an alarm switch 32 can be wired into the plug wiring 31, as illustrated in FIG. 1, or in the antenna deployment wiring 42, illustrated in FIG. 8, and the alarm switch 32 is provided with an alarm switch button 33, for manual operation of an audible alarm such as the horn 26, illustrated in FIG. 1, in either the embodiment of the water skier safety alarm illustrated in FIGS. 1 and 2 or that illustrated in FIGS. 8–10, as desired. Accordingly, it is understood that a passenger or observer who is observing the water skier or skiers while the driver is operating the boat may activate the alarm switch 32 to instantly command the attention of the driver under circumstances where a water skier falls or drops the tow rope after a run or in any dangerous situation of which the driver is unaware.

Figure 6A:
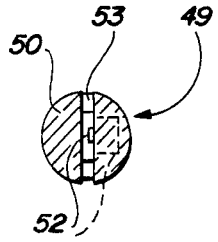
FIG. 6A is a sectional view taken along line 6A—6A of the tow rope handle illustrated in FIG. 6.

Referring now to FIGS. 6 and 6A of the drawings, in a preferred embodiment of the invention, either the water skier safety alarm 1 illustrated in FIGS. 1 and 2 or the antenna deployment apparatus 36 illustrated in FIGS. 8–10, may be coupled by means of the tow rope wiring 44 to a pressure switch 52, located in a split handle 49, which is fitted with a handle harness 47 that is constructed of rope strands 46, plaited into the tow rope 45. The two handle harness members 47 are extended through drilled and registering holes (not illustrated) provided in the inside handle segment 50 and the matching outside handle segment 51 of the split handle 49 and a harness knot 48 is knotted in the extending ends of each of the handle harness elements 47, to secure the handle harness 47 and the tow rope 45 to the split handle 49, as illustrated in FIG. 6. The pressure switch 52 is installed in the outside handle segment 51 of the split handle 49 and the inside handle segment 50 and outside handle segment 51 are spaced by a handle segment slot 53, into which the pressure-operable portion of the pressure switch 52 protrudes. Accordingly, it will be appreciated by those skilled in the art that when a skier grips the split handle 49, the handle segment slot 53 is closed and pressure is exerted against the pressure-operable portion of the pressure switch 52 which extends into the handle segment slot 53. The pressure switch 52 is thus activated to facilitate operation of the solenoid 6 and retraction of the flag 25 into the phantom position of the water skier safety alarm 1 illustrated in FIG. 1 or, in the case of the embodiment of the antenna deployment apparatus 36 illustrated in FIGS. 8–10, telescopic retraction of the flag 25 inside the antenna housing 38, as illustrated in FIG. 8. Conversely, release of the split handle 49 by the water skier allows the pressure switch 52 to open and facilitates pivotal extension of the flag staff 24 and the flag 25 into the upright position as illustrated in FIG. 1, responsive to reversal of the voltage in the solenoid 6 and retraction of the solenoid piston 8 into the piston chamber 7. Release of the split handle 49 also effects telescopic extension of the flag staff 24 and the flag 25 into the functional configuration illustrated in FIG. 9, responsive to operation of the relay (not illustrated), provided in the antenna deployment apparatus 36.

Referring now to FIG. 7 of the drawings, in an alternative preferred embodiment of the invention, a laminated handle 55 is provided, wherein an inside conducting layer 56 is fitted to the rod-shaped tow rope handle 54. An insulating layer 57 is then wrapped around the inside conducting layer 56 and the insulating layer 57 is provided with multiple, spaced conducting layer openings 59, as further illustrated in FIG. 7. An outside conducting layer 58 is then wrapped around the insulating layer 57, in order to complete the rod-shaped tow rope handle 54. The tow rope wiring 44 is attached to the inside conducting layer 56 and the outside conducting layer 58 and contact between the inside conducting layer 56 and the outside conducting layer 58 is effected to complete the alarm circuit at specific conducting layer openings 59 which are gripped by the skier. This completion of the circuit effects retraction of the flag staff 24 and the flag 25 into the phantom position illustrated in FIG. 1 with respect to the water skier safety alarm 1 of this invention and retraction of the flag 25 and the flag staff 24 inside the antenna housing 38, as illustrated in FIG. 8 in the antenna deployment apparatus 36.

It will be appreciated by those skilled in the art that the tow rope 45 is secured to the boat 35 in conventional fashion, with the split handle 49 or the laminated handle 55 attached to the extending end thereof by means of the handle harness 47. Furthermore, the water skier safety alarms of this invention, in both embodiments thereof, are characterized by convenience, flexibility and efficiency in notifying the drivers of a tow boat and other boats in the vicinity that a water skier is in the water. The water skier safety alarm 1 and the antenna deployment apparatus 36 can be quickly and easily mounted to substantially any boat in any desired location and the pressure switches located in the split handle 49 and the laminated handle 55, illustrated in FIGS. 6 and 7, respectively, can be implemented and the tow rope wiring 44 plaited in the tow rope 45 or retrofitted to existing tow ropes 45, using the cable ties 34, as desired.

It will be further understood that various other types of switching mechanisms, including electric eye and remote-control devices well known to those skilled in the art, may be utilized to trigger the water skier safety alarm 1 and the antenna deployment apparatus 36 and the use of such devices as well within the scope of the present invention. Accordingly, while the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A water skier safety alarm for a boat equipped with a tow rope having a tow rope handle, comprising flag deployment means carried by the boat; a flag staff carried by said flag deployment means in telescoping relationship and a flag secured to the extending end of said flag staff; normally open switch means provided in the tow rope handle; and wiring provided in the tow rope, said wiring connecting said flag deployment means to said switch means for activating said flag deployment means and raising said flag staff and said flag from a retracted position to an extended position responsive to release of the tow rope handle by a skier and opening of said switch means.

2. The water skier safety alarm of claim 1 wherein said switch means further comprises a tow rope handle having an inside segment and an outside segment spaced from said inside segment and a pressure switch disposed in said tow rope handle between said inside segment and said outside segment, whereby said pressure switch is closed to complete the electrical circuit from said pressure switch through said wiring and said flag deployment means, said flag staff and said flag are maintained in said retracted position when the skier grips the tow rope handle and said pressure switch is opened to break said circuit and raise said flag staff and said flag into said extended position when the skier releases the tow rope handle.

3. The water skier safety alarm of claim 1 wherein said wiring is plaited in the tow rope.

4. The water skier safety alarm of claim 1 wherein said wiring is substantially aligned with the tow rope and further comprising a plurality of spaced cable ties joining said wiring to the tow rope.

5. The water skier safety alarm of claim 1 further comprising audible alarm means electrically connected to said wiring and said switch means for sounding an audible alarm when said switch means is opened.

6. The water skier safety alarm of claim 1 further comprising manual switch means electrically connected to said wiring for manually deactivating said flag deployment means.

7. The water skier alarm of claim 1 wherein said switch means further comprises said tow-rope handle having a first conducting layer; an insulating layer provided on said first conducting layer; a plurality of openings provided in said insulating layer in spaced relationship; and a second conducting layer provided on said insulating layer, said first conducting layer and said second conducting layer comprising a pressure switch and wherein said wiring is connected to said first conducting layer and said second conducting layer to complete said pressure switch, whereby the electrical circuit is completed from said tow-rope handle through said wiring and said flag deployment means and said flag staff and said flag are maintained in said retracted position when the skier grips the tow-rope handle and said pressure switch is opened to break said circuit and raise said flag staff and said flag into said extended position when the skier releases the tow-rope handle.

8. The water skier safety alarm of claim 7 wherein said wiring is plaited in the tow rope.

9. The water skier safety alarm of claim 7 further comprising a plurality of spaced cable ties securing said wiring in the tow-rope.

10. The water skier safety alarm of claim 7 wherein said flag deployment means further comprises an antenna deployment apparatus having a motor, a motor housing enclosing said motor, an antenna housing carried by said motor housing and a telescoping antenna mounted in said antenna housing, with said flag staff carried by said antenna, whereby release of said tow rope handle by the skier opens said switch means and causes said antenna, said flag staff and said flag to extend from said antenna housing in telescoping relationship.

11. The water skier safety alarm of claim 10 further comprising audible alarm means electrically connected to said wiring and said switch means for sounding an audible alarm when said switch means is opened.

12. The water skier safety alarm of claim 11 further comprising manual switch means electrically connected to said wiring and said switch means for manually deactivating said flag deployment means.

* * * * *